US006454139B1

(12) United States Patent
Bayer

(10) Patent No.: US 6,454,139 B1
(45) Date of Patent: Sep. 24, 2002

(54) PREASSEMBLED AEROSOL ACTUATOR ASSEMBLY FOR IN-LINE CAPPING TO AN AEROSOL CONTAINER

(75) Inventor: Christian Bayer, Armonk, NY (US)

(73) Assignee: Precision Valve Corporation, Yonkers, NY (US)

( * ) Notice: Subject to any disclaimer, the term of this patent is extended or adjusted under 35 U.S.C. 154(b) by 36 days.

(21) Appl. No.: 09/783,490

(22) Filed: Feb. 14, 2001

(51) Int. Cl.[7] ..... B65D 83/20
(52) U.S. Cl. ..... 222/402.13; 222/183
(58) Field of Search ..... 222/402.13, 182

(56) References Cited

U.S. PATENT DOCUMENTS

| | | | | |
|---|---|---|---|---|
| 3,347,423 A | | 10/1967 | Rahn et al. | |
| 3,377,005 A | | 4/1968 | Marder | |
| 3,674,184 A | * | 7/1972 | Ewald | 222/182 |
| 3,872,651 A | | 3/1975 | Leonard | |
| 4,132,333 A | | 1/1979 | Debard | |
| 5,388,730 A | | 2/1995 | Abbott et al. | |
| 5,899,623 A | * | 5/1999 | De Laforcade | 222/402.13 |
| 5,915,597 A | * | 6/1999 | De Laforcade | 222/182 |
| 6,006,957 A | * | 12/1999 | Kunesh | 222/402.13 |
| 6,161,736 A | * | 12/2000 | Kaufman et al. | 222/402.13 |

FOREIGN PATENT DOCUMENTS

| | | |
|---|---|---|
| GB | 1 493 032 | 11/1977 |
| GB | 2 023 745 | 1/1980 |
| GB | 2 099 513 | 12/1982 |
| WO | WO 98/28207 | 7/1998 |

* cited by examiner

*Primary Examiner*—Lesley D. Morris
*Assistant Examiner*—Stephanie Willatt
(74) *Attorney, Agent, or Firm*—Kilgannon & Steidl

(57) ABSTRACT

A preassembled aerosol actuator assembly and a method of in-line capping the assembly to an aerosol container. A shell has a top opening and a hinged actuator lever therein with a depending button-receiving socket. A discrete spray button is preassembled into the socket with the button bottom positioned a substantial distance above the socket bottom to leave a stem-capturing space below the button. The button has an upwardly extending interior passage with a wide lead-in beginning at the bottom end of the button directly adjacent the outer side wall of the button and converging upwardly to terminate in a shallow valve stem-sealing socket. The bottom of the button has no obstructions and no unintended stem-capturing openings. The button socket has a side spray slot closed at the bottom by a radiused flap. Heat-dissipating interior channels are cored from the button top down into the button.

22 Claims, 9 Drawing Sheets

PREASSEMBLED AEROSOL ACTUATOR ASSEMBLY FOR IN-LINE CAPPING TO AN AEROSOL CONTAINER

FIELD OF THE INVENTION

The present invention relates to an improved preassembled aerosol actuator assembly of the type containing a separate discrete spray button for use with a product container topped by an aerosol valve with a valve stem extending upwardly therefrom. More particularly, the present invention relates to an improved preassembled aerosol actuator assembly particularly adapted for in-line capping of the actuator assembly onto the product container. Further, the improved assembly is adapted to prevent undesired product-dispensing actuation of the aerosol valve stem during capping of the assembly onto the product container.

BACKGROUND OF THE INVENTION

Aerosol actuator assemblies of the type utilizing a separate discrete spray button are known, wherein such buttons with different spray patterns/characteristics for different aerosol products may be used with a single design of actuator. The manufacturing efficiencies of having a single design of actuator for multiple designs of buttons is self evident. The button commonly is positioned in a button-receiving socket which depends from an actuator lever pivotally hinged from the shell or dome of the aerosol actuator. The button may be initially mounted on an aerosol valve stem followed by applying the actuator over the mounted button to position the button in the socket and cap the actuator onto the product container.

It is also desirable and known to preassemble the discrete spray button into the button-receiving socket depending from the actuator lever, followed by capping of the preassembled actuator assembly with button onto the aerosol product container. The manufacturer of the actuator and button may carry out the preassembly before shipping the preassembled actuator assembly to the product filler, who then can apply and cap the preassembled actuator as received in a single step. This, as opposed to the button and actuator being shipped unassembled to the filler, the filler then having to do the first step of mounting the button to the aerosol valve stem followed by the second step of applying the actuator over the mounted button and completing the capping operation.

Product fillers generally own capping machines known as in-line cappers which have been commonly used for many years to place caps on aerosol containers. A general example of such a capper is shown in U.S. Pat. No. 3,872,651 issued Mar. 25, 1975 to The Kartridg Pak Co. In such KP in-line cappers, various forms of caps for aerosol containers are moved down an inclined conveyor and placed onto product containers also moving along a conveyor at essentially the same speed as the caps. Thereafter, the caps are pushed downward to attach onto the container. To date, however, it has not been feasible to consistently cap the above-designated preassembled aerosol actuators onto product containers in an in-line capping machine. This is due to inadequacies in the design of the preassembled aerosol actuators, and accordingly a filler wishing to use such preassembled aerosol actuators may need to purchase more specialized and expensive forms of capping machines rather than use in-line cappers already in the filler's plant.

In-line capping machines in operation generally have substantial inherent vibration. In prior art preassembled aerosol actuators of the above-described type wherein the discrete spray button is mounted within the button-receiving socket depending from the pivotal actuator lever, such sockets generally do not have a sufficient lead-in space below the bottom of the button for the valve stem, resulting in the valve stem bouncing or vibrating out of the socket during in-line capping; and/or the socket has structural obstructions and/or unintended valve stem-capturing openings so that bouncing or misalignment of the valve stem can occur upon in-line capping; and/or the spray button itself has structural obstructions and/or unintended valve stem-capturing openings at the bottom end of the button other than the intended valve stem opening, and/or an inadequate lead-in profile into the intended valve stem opening, such that a bouncing or vibration of the valve stem out of the button structure or misalignment of the valve stem with the button can occur upon in-line capping. Further, the button-receiving socket depending from the actuator lever commonly has a spray slot in its wall extending to the bottom end of the socket, which slot also provides a path for the valve stem to escape the bottom end of socket as the actuator assembly undergoes in-line capping. It will be appreciated that even a few instances of improper capping of such preassembled aerosol actuators during in-line capping can be quite disruptive of the efficiencies of the filler's operation.

It is also a desideratum of in-line capping of the preassembled actuator assemblies that undesired product-dispensing actuation of the aerosol valve not occur during the capping operation. Prior art button structures commonly have valve stem-sealing sockets that are excessive in depth, whereby the passage of the valve stem into the stem-sealing socket may cause such undesired product-dispensing actuation of the aerosol valve unless other steps are taken such as maintaining the stem out of contact with the button during capping.

SUMMARY OF THE INVENTION

The present invention provides an actuator assembly for use with an aerosol product container topped by an aerosol valve with a valve stem extending upwardly therefrom. This assembly is particularly adapted for use with in-line capping equipment, but of course may be used with other types of capping equipment if desired in a particular instance. The assembly has an actuator shell with an open bottom for mounting to the filled aerosol product container, and a shell top with an opening within which is positioned an actuator lever member having a first end hinged to the shell and a second end free to pivot. A button receiving socket depends from the lever and has a bottom open end. A discrete spray button is preassembled into and retained in the button-receiving socket, the button having an outer side wall and a bottom end positioned, upon preassembly, a substantial distance above the bottom open end of the button-receiving socket. The discrete button further has an upwardly extending interior passage with a wide lead-in beginning at the bottom end of the button directly adjacent the outer side wall of the button and converging upwardly to terminate in a stem-sealing socket for the valve stem. The bottom end of the button accordingly is characterized by the absence of obstructing structure and unintended valve stem-capturing openings to bounce or misalign the valve stem upon in-line capping of the actuator assembly. The lead-in, obstruction-free, distance from the bottom of the button-receiving socket to the bottom of the preassembled button first captures and retains the valve stem in the bottom of the socket as the actuator is delivered onto the container during in-line capping, and the valve stem is thereafter passed up the smooth lead-in profile of the upwardly converging interior button passage to the stem-receiving socket as the in-line capping is completed.

The button-receiving socket of the present invention has a side wall slot, which may extend to the bottom of the socket for ease in molding, through which spray from the spray button passes (as well as through an aligned opening in the shell side wall) upon actuation of the aerosol valve. The nozzle of the button is aligned with the slot by a respective tongue and groove arrangement between the button and interior side wall of the socket, and an interference fit is created by the tongue and groove to frictionally retain the button in the socket. Where the slot extends to the bottom of the socket, a flap is molded exterior to the socket adjacent the slot at the bottom end of the socket, thus assuring that once the valve stem is captured in the lower end of the socket below the button during capping, the valve stem prior to entering the button cannot immediately exit the socket through the slot to result in an unsuccessful capping.

In order to assure that unintended product-dispensing actuation by the aerosol actuator assembly does not occur during capping, the stem-sealing socket at the top of the interior converging button passage has a shallow depth so that penetration of the valve stem into the socket will not actuate the valve stem sufficient to dispense product. Further, the hinged connection of the actuating lever to the shell is designed to be sufficiently thin and flexible such that the force to pivot the actuator lever upwardly during capping is less than the force to move the valve stem downwardly to a product-dispensing position. Accordingly, if a valve stem has an excessive height dimension because of stem/container tolerances, the top of the valve stem acting through the stem-sealing socket of the button will merely pivot the actuator lever slightly upward rather than creating the undesirable occurrence of the valve stem being actuated to dispense product during capping.

Aerosol spray buttons are commonly molded, and for well-known reasons relating to the need for heat dissipation during molding, such buttons have cored passages therein commonly extending upwardly from the bottom of the button to dissipate heat. The improved button of the present invention has its bottom interior upwardly converging stem passage extending from directly adjacent the outer wall of the button, and accordingly interior heat-dissipating channels are cored a substantial distance down into the button from its top.

The improved preassembled aerosol actuator assembly of the present invention overcomes the above-noted deficiences in design of prior art preassembled actuators, and as noted is particularly adapted for in-line capping to an aerosol product container.

Other features and advantages of the present invention will be apparent from the following description, drawings and claims.

DESCRIPTION OF EMBODIMENT

Figure 1:
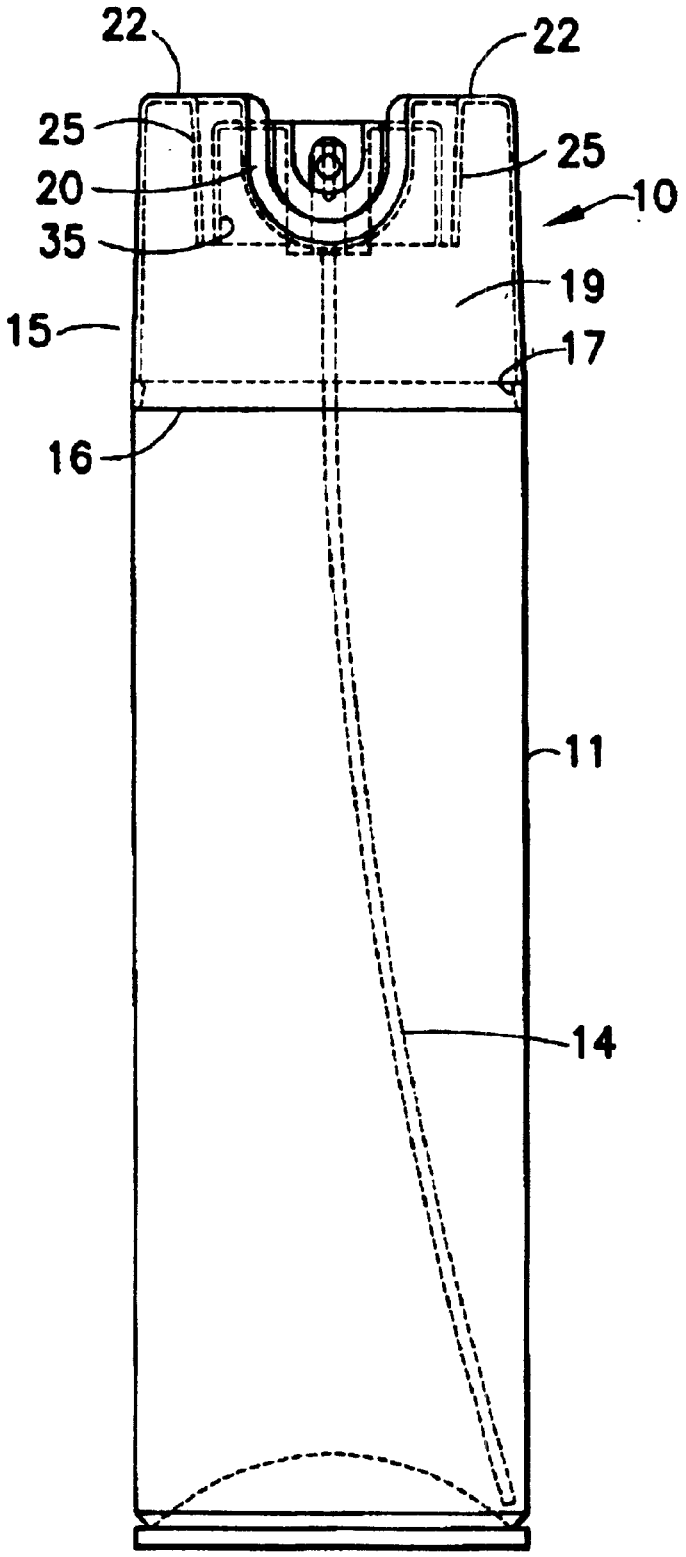
FIG. 1 is a front elevational view of the preassembled aerosol actuator assembly of the present invention mounted onto an aerosol product container.
Figure 2:
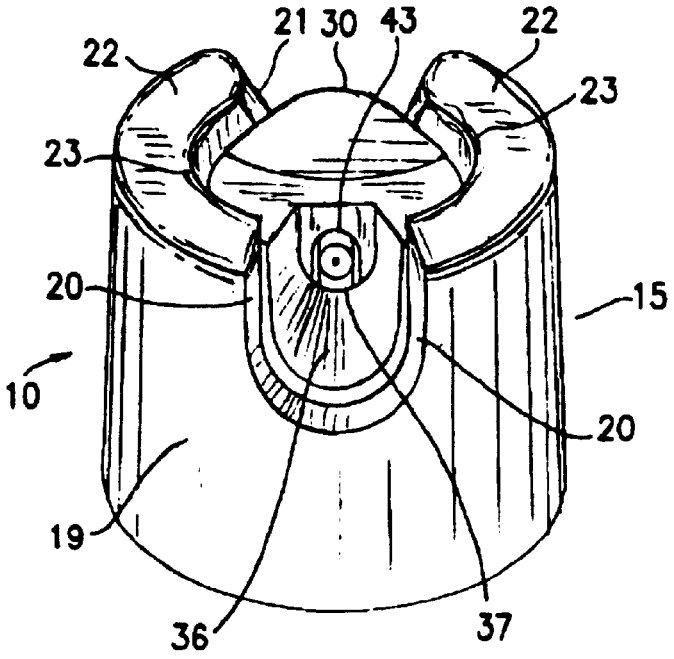
FIG. 2 is an overhead perspective view from the front of the preassembled aerosol actuator assembly of the present invention.
Figure 3:
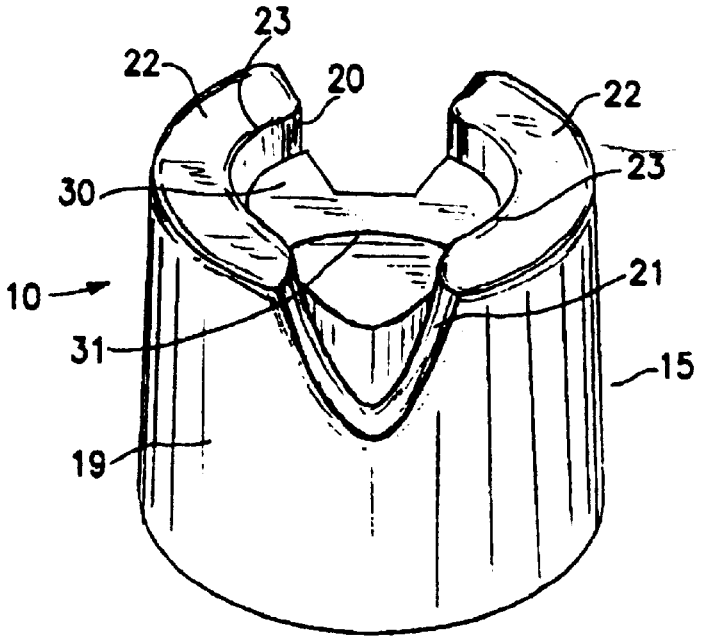
FIG. 3 is an overhead perspective view from the rear of the preassembled aerosol actuator assembly of the present invention.
Figure 4:
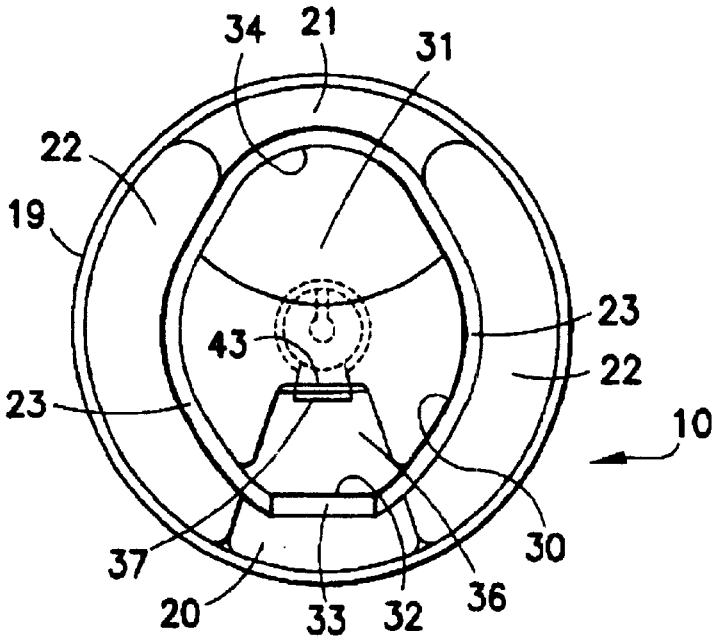
FIG. 4 is an overhead plan view of the preassembled aerosol actuator assembly of the present invention.
Figure 5:
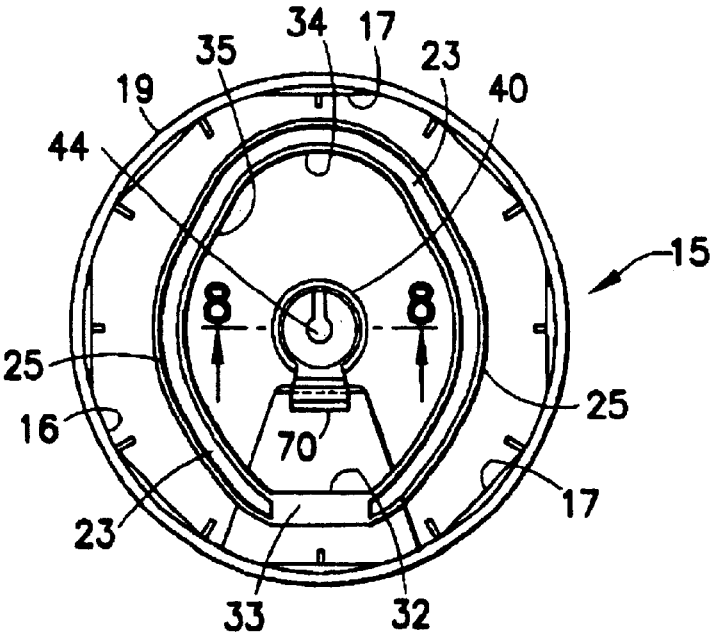
FIG. 5 is a bottom view of the aerosol actuator of the present invention with the spray button removed.
Figure 11:
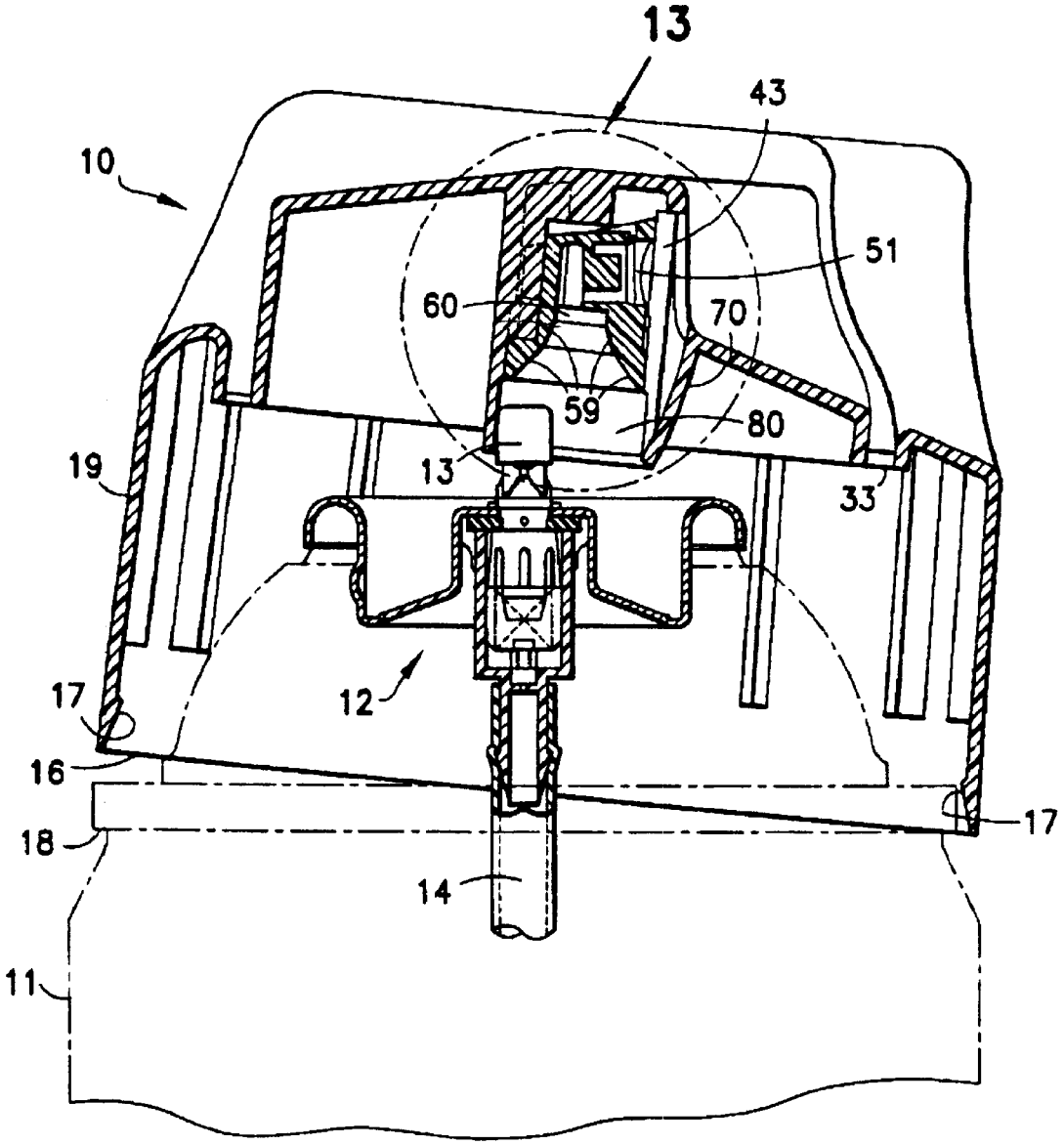
FIG. 11 is a cross-sectional view from front to rear and through the central axis of the preassembled aerosol actuator assembly (with spray button) of the present invention, illustrating the initial in-line capping operation wherein the valve stem has been first captured by the bottom of the button-receiving socket below the button.
Figure 12:
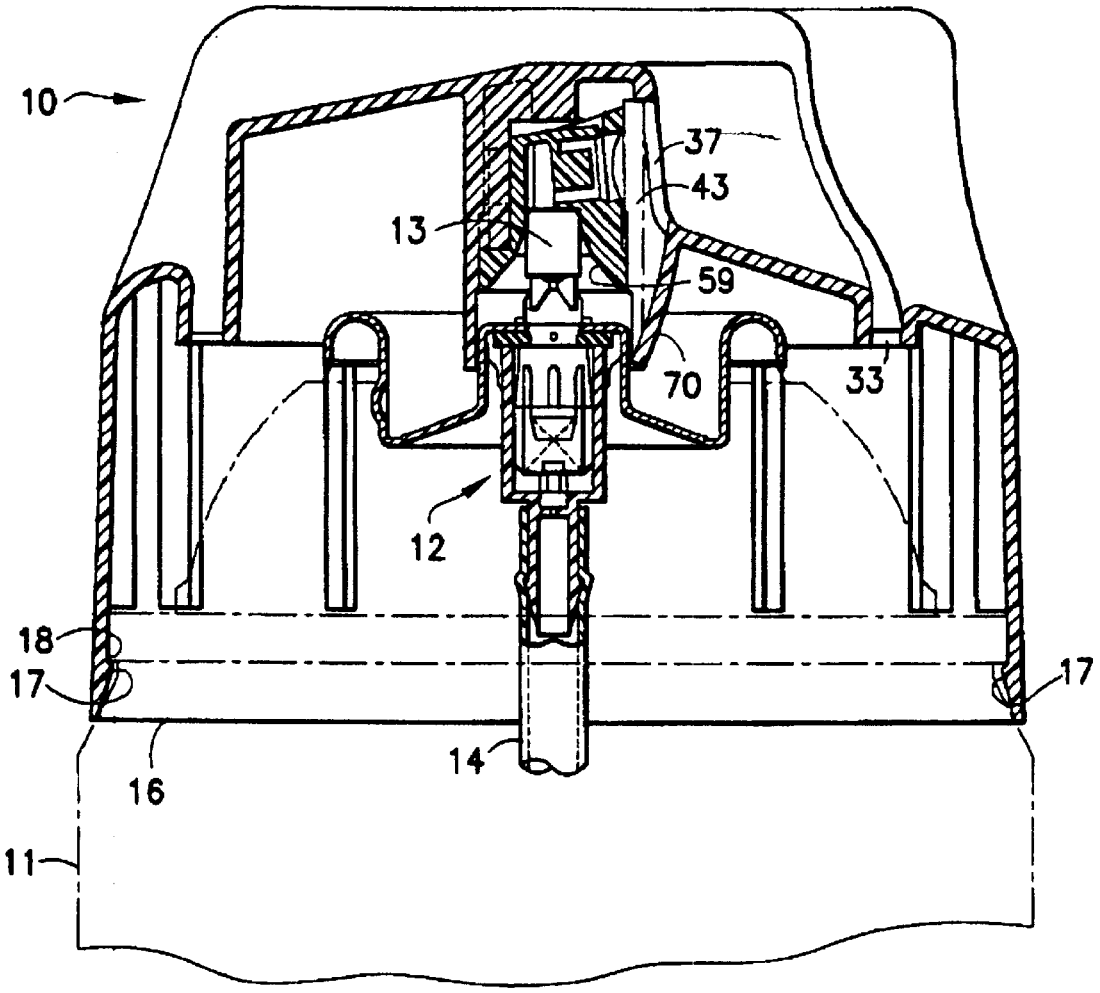
FIG. 12 is a cross-sectional view from front to rear and through the central axis of the preassembled aerosol actuator assembly (with spray button) of the present invention, illustrating the completion of the in-line capping operation wherein the valve stem is seated in the stem-receiving socket at the top of the upwardly converging interior button passage.

FIG. 1 illustrates preassembled aerosol actuator assembly 10 of the present invention mounted on a conventional aerosol product container 11. Aerosol valve 12 with valve stem 13 tops container 11 in known fashion (as shown in FIGS. 11 and 12), and dip tube 14 extends downwardly from valve 12 into the product container. The parts of actuator assembly 10, as hereinafter described, are all molded of plastic.

Referring to FIGS. 1–8, actuator assembly 10 comprises an actuator shell 15 having a bottom opening 16 with spaced inwardly directed horizontal detents 17 for engaging under the can seam 18 upon capping to hold the shell 15 on the aerosol container. Shell 15 has a side wall 19 with spray passage 20 and finger passage 21 extending therethrough, and top 22 having opening 23 therein. Internal spaced vertical ribs 24 serve to provide stability to shell 15. Likewise, as to internal skirt 25 which extends downwardly from top 22 of the shell and surrounds top opening 23.

Actuator lever member 30 is positioned within shell top opening 23 and has a finger actuating top surface 31 which is recessed slightly below shell top 22 to prevent inadvertent actuation on stacking and shipping of product containers capped by the present invention. End 32 of actuator lever member 30 is hinged to the shell 15 by a thin and flexible integral hinge 33, and end 34 of actuator lever member 30 freely floats so that it can be pivoted downwardly about hinge 33 upon finger actuation. Likewise, end 34 can be pivoted upwardly about hinge 33 for reasons hereinafter more fully discussed. Actuator lever member 30 includes skirt 35, and a recessed front portion 36 to provide access to spray opening 37 aligned with spray passage 20 in the shell side wall 19.

Depending downwardly from the underside of top surface 31 of actuator lever member 30 is a spray button-receiving socket 40. Socket 40 includes a bottom end 41, a wall 42 extending upwardly from bottom end 41, and a spray slot 43 extending through socket wall 42 and aligned with spray passage 37 (essentially an outwardly directed continuation of spray slot 43) and spray passage 20. For ease in molding, spray slot 43 may also extend to the bottom end 41 of socket 40. Button-receiving socket 40 is centrally positioned within the actuator assembly 10 and includes at its top a downwardly-extending protuberance 44 (see FIGS. 6 and 8) to limit the upward travel of the spray button 50 hereinafter described upon preassembly. Button-receiving socket 40 may have a slightly decreasing diameter in the upward direction to accommodate a slight taper on the spray button 50. Button-receiving socket 40 further includes an inwardly extending vertical rib or tongue 45 for use in aligning the spray button 50 as hereinafter described.

Figure 9:
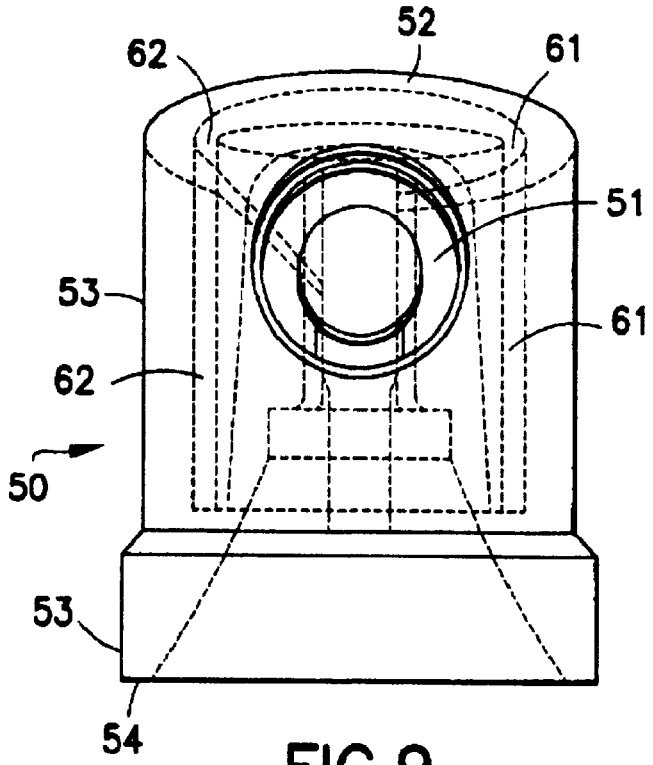
FIG. 9 is a front elevational view of the button of the present invention.
Figure 10:
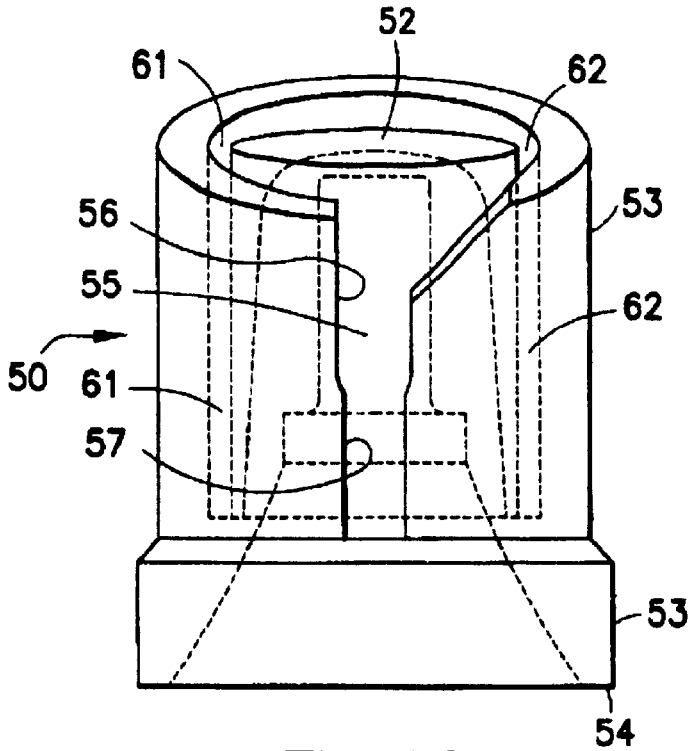
FIG. 10 is a rear elevational view of the button of the present invention.

Discrete one or two-piece spray button 50 is shown in FIGS. 9 and 10, and is preassembled into button-receiving socket 40 as illustrated in FIGS. 1,2 and 11–13 to form the preassembled actuator assembly 10 of the present invention. The assembly 10 preferably will be sold and shipped in preassembled form from the manufacturer to the product filler.

Spray button 50 is a plastic molded member having front nozzle 51 and well-known internal passages for the transport of product out the nozzle 51 when the button 50 is mounted on the end of aerosol valve stem 13 and the aerosol valve 12 is actuated. Spray button 50 has an upwardly sloping top end 52, an outer side wall 53, and a circular bottom end 54. Button 50 at its rear end opposite nozzle 51 has a groove 55, so that when the button 50 is inserted into button-receiving socket 40, the socket rib or tongue 45 will extend into groove 55 to properly align the button nozzle 51 to spray out through socket spray slot 43 upon actuation. Button groove 55 has a wider upper portion 56 and a narrower lower portion 57, portion 57 providing a slight interference fit with socket rib 45 to frictionally retain button 50 in socket 40 when the button is fully inserted up against socket protuberance 44 during preassembly of the actuator.

Figure 13:
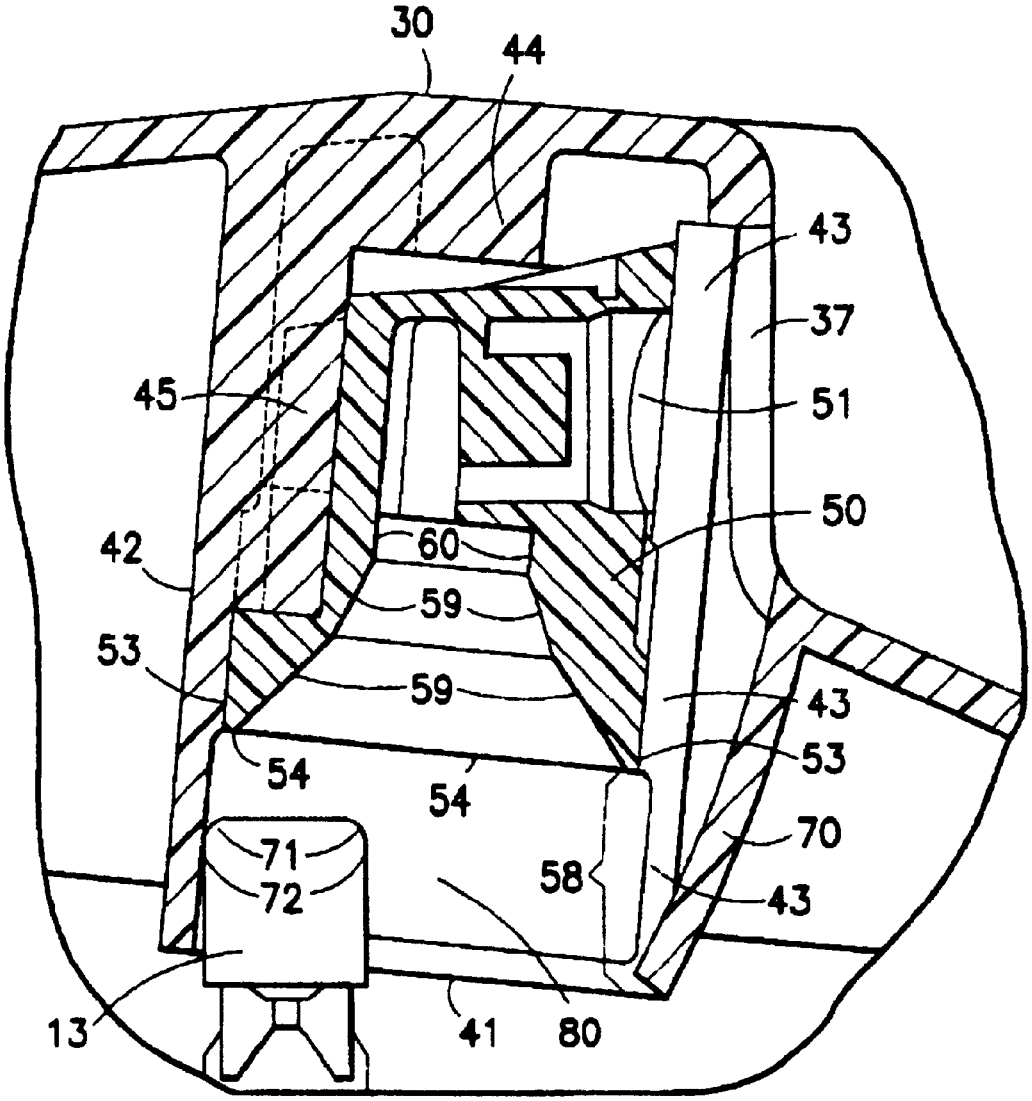
FIG. 13 is a enlarged partial view taken from FIG. 11.

It will be noted from FIG. 13 that button 50 when fully preassembled into the actuator has its bottom end 54 spaced a substantial distance 58 above the bottom end 41 of the button-receiving socket 40. Button 50 further has an upwardly extending interior passage 59 (essentially frustoconical) with a wide lead-in beginning at the bottom end 54 of the button directly adjacent the outer side wall 53 of the button and smoothly converging upwardly to terminate in a shallow stem-sealing socket 60 for receiving the valve stem 13. Contrary to the prior art, there are no obstructions and no unintended valve stem-capturing openings at the bottom of the button, and an initially wide lead-in profile for the valve stem is provided.

Button 50 further has interior channels 61 and 62 as shown in FIGS. 9 and 10, these channels being cored a substantial distance from the top of the button 50 down into the body of the button for heat dissipation during the molding process. Channels 61 and 62 are in full vertical communication with and extend in opposite directions away from groove 55 as shown in FIG. 10, and groove 55 may be molded at the same time as channels 61 and 62 are cored. Channels 61 and 62 in plan view are circular arcs each extending from groove 55 in opposite directions a substantial distance around toward the front (nozzle) side of the button 50.

Figure 6:
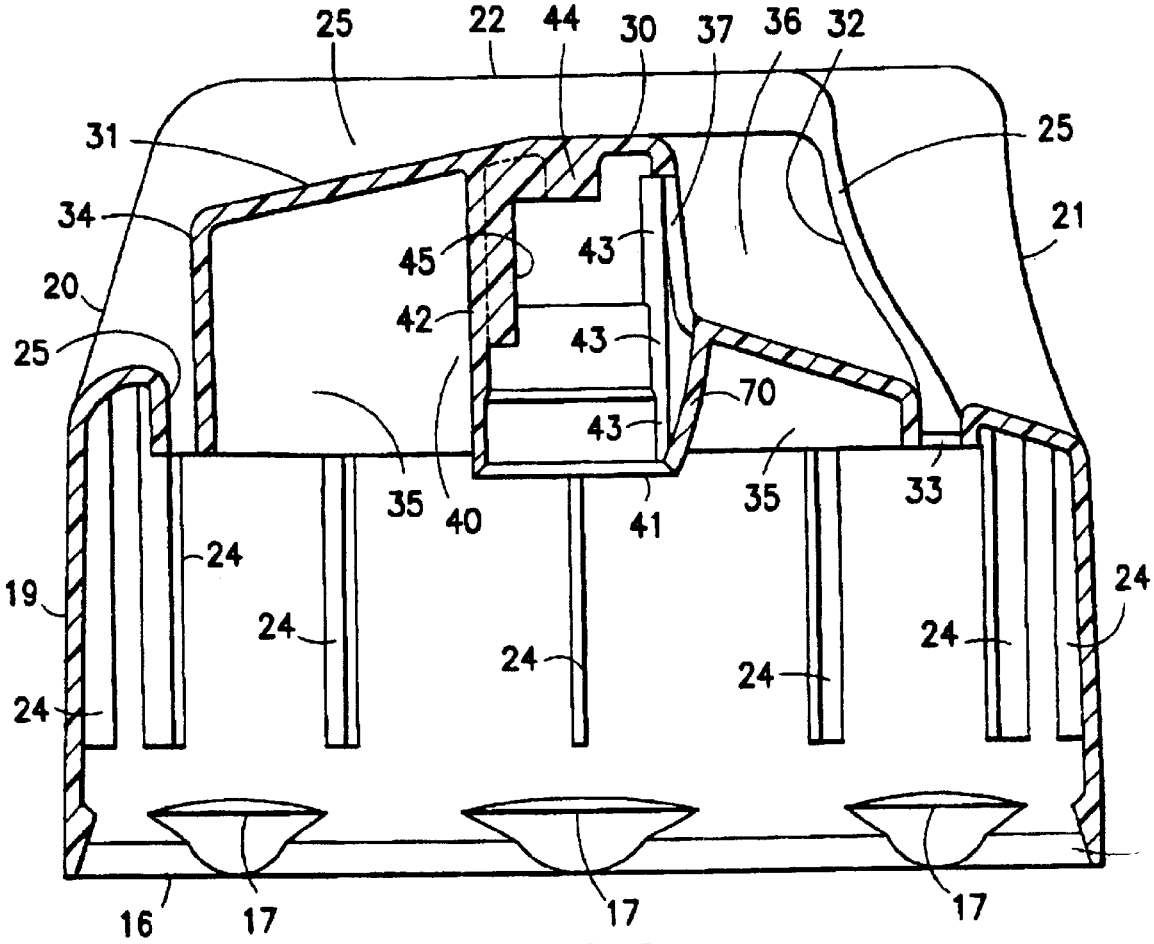
FIG. 6 is a cross-sectional view from front to rear and through the central axis of the aerosol actuator of the present invention with the spray button removed.
Figure 7:
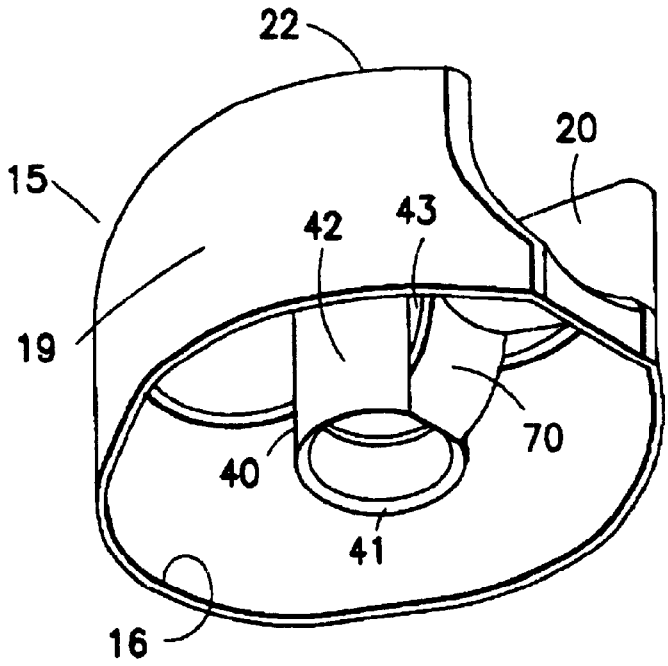
FIG. 7 is an underneath perspective view from the side of the aerosol actuator of the present invention with the spray button removed.
Figure 8:
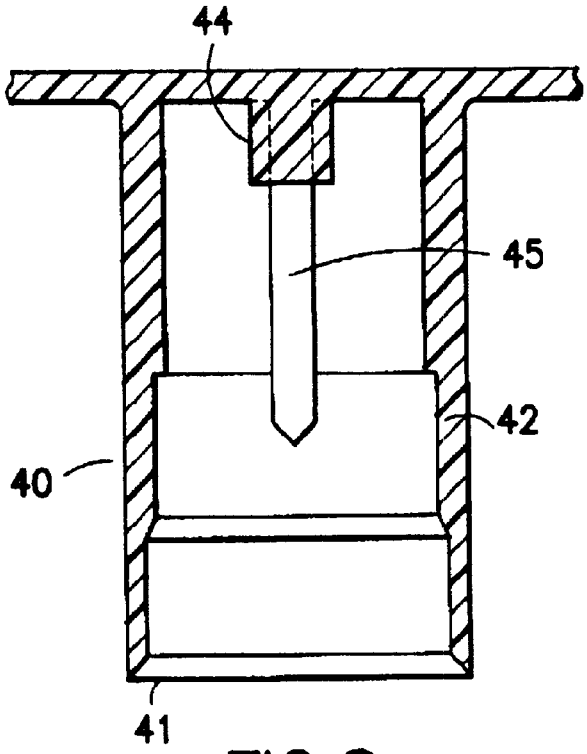
FIG. 8 is a partial cross-sectional view along lines 8—8 of FIG. 5.

To complete the structural description of the aerosol actuator, reference is made to FIGS. 6, 7 and 13 illustrating molded flap 70 positioned adjacent the button-receiving socket spray slot 43 directly adjacent where the slot 43 extends to the bottom of button-receiving socket 40. Flap 70 is provided for reasons hereinafter described, and may be radiused as shown in a direction downwardly and inwardly toward slot 43. Flap 70 is molded essentially in the position shown in FIGS. 6, 7 and 13. When the molding core pin and insert is withdrawn, the bottom of the flap is bent to a straight position away from the slot 43, but the radius memory of the flap bends flap 70 again back to the radiused position shown in the drawings.

Now turning to the unique adaptability to in-line capping of the improved preassembled aerosol actuator assembly of the present invention, reference is made particularly to FIGS. 11–13. FIG. 11 and FIG. 13 illustrate the initial in-line capping operation where the preassembled actuator assembly has just been dropped or positioned over the moving product container 11 and valve stem 13 has been initially captured in lead-in socket space 80 (cylindrical except for slot 43) below the bottom 54 of spray button 50. Because of the distance 58 between the bottom 41 of the button-receiving socket and the bottom 54 of spray button 50, for example 0.220 inches, the valve stem 13 does not bounce off the button 50 or vibrate back out of the socket space 80. Distance 58 may be more or less than 0.220 inches, but subject to the requirement that distance 58 be sufficient to retain the valve stem 13 in space 80. Flap 70 acts to prevent valve stem 13 exiting the socket space 80 through the lower end of slot 43 in the button-receiving socket.

Referring to FIG. 12, the in-line capping operation thereafter continues to completion with valve stem 13 passing up the button converging interior passage 59 without any obstruction or misalignment into the stem-sealing socket 60. At the same time, the shell 15 is attached to the product container 11 by being pushed down towards the container by the in-line capping equipment. The bottom end of socket 40 now surrounds the pedestal of the mounting cup for the aerosol valve.

As previously discussed, the improved preassembled aerosol actuator assembly of the present invention is also adapted to prevent undesired product-dispensing actuation of the aerosol valve stem during capping of the assembly onto the product container. Stem-sealing socket 60 is of shallow depth. For a depth of 0.04 inches from top to bottom, as an example, and with the top of valve stem 13 having an outside radius 71 of 0.02 inches, the side 72 of valve stem 13 will only make frictional stem-sealing contact with 0.02 inches of the side of the stem-sealing socket 60 when valve stem 13 is fully seated in the socket 60. The shallow socket 60, and the small extent of sealing contact between the valve stem 13 and the socket, assures that the completion of the capping operation will not serve to depress valve stem 13 sufficiently to actuate the aerosol valve to a product-dispensing position. Further, if the top of valve stem 13 should be particularly high due to tolerance variations of the product container or valve stem, the top of valve stem 13 will act when seated in socket 60 to pivot the actuator lever member 30 upwardly about thin and flexible hinge 33 as previously discussed, rather than unintentionally actuating the aerosol valve to dispense product during capping. This action is due to the force to pivot the actuator lever member 30 upwardly being designed to be less than the force to move the valve stem 13 downwardly.

It will be appreciated by persons skilled in the art that variations and/or modifications may be made to the present invention without departing from the spirit and scope of the invention. The present embodiment is, therefore, to be considered as illustrative and not restrictive. It should also be understood that such terms as "upper", "lower", "inner", "outer", "horizontal", "vertical", "top", "bottom", "above", "below", and corresponding positional terms as used in the specification are intended in relation to the positioning shown in the drawings, and are not otherwise intended to be restrictive.

What is claimed is:

1. A preassembled aerosol actuator assembly for use with an aerosol product container topped by an aerosol valve with a valve stem extending upwardly therefrom, comprising in combination: an actuator shell having a bottom opening with means adjacent thereto for attaching the actuator shell to the product container, a shell side wall with a spray passage therethrough, and a shell top, said shell top having an opening therein; an actuator lever positioned within the shell top opening, said actuator lever having a top actuating surface, a first end hinged to the shell, a second end free to pivot downwardly upon actuation of the lever, and a spray button-receiving socket depending from the lever; said socket including a bottom end, a wall extending upwardly from the bottom end, and a slot extending through said socket wall aligned with the shell side wall spray passage; a discrete spray button preassembled into and retained in the spray button-receiving socket, said button having a spray nozzle aligned with the socket side wall slot, a top end, an outer side wall, and a bottom end; said bottom end of the preassembled button being spaced a substantial distance above the bottom end of the button-receiving socket; said button having an upwardly extending interior passage with a wide lead-in beginning at the bottom end of the button directly adjacent the outer side wall of the button and converging upwardly to terminate in a stem-sealing socket for receiving the valve stem; said bottom end of the button being characterized by the absence of obstructions and unintended valve stem-capturing openings; whereby upon positioning the preassembled aerosol actuator onto the product container during capping, the valve stem is first captured by the button-receiving socket extending below the bottom end of the preassembled button and thereafter is passed up the said interior converging passage of the button without obstruction or misalignment to the stem-receiving socket as the capping is completed.

2. The invention of claim 1, wherein the side wall slot in the button-receiving socket extends to the bottom end of said socket, and a flap is positioned exterior to said button-receiving socket directly adjacent said slot at the bottom end of said socket, thereby assuring retention of the valve stem within the button-receiving socket below the preassembled button upon the initiation of capping.

3. The invention of claim 2, wherein the flap is radiused in a direction downwardly and inwardly toward said slot.

4. The invention of claim 1, wherein the stem-sealing socket in said button has a sufficiently shallow depth to permit capping of the aerosol actuator assembly without product-dispensing actuation of the aerosol valve stem during capping.

5. The invention of claim 4, wherein the force to pivot the actuator lever upwardly during capping is less than the force to move the valve stem downwardly to product-dispensing position during capping.

6. The invention of claim 1, wherein said button interior converging passage is generally frustoconical in shape.

7. The invention of claim 1, wherein the button-receiving socket and the button together include an interfitting tongue and groove to align the button nozzle with the side wall slot of the button-receiving socket upon preassembly of the button into the socket, and further including a slight interference fit between said tongue and groove to frictionally retain said spray button in said button-receiving socket upon preassembly.

8. The invention of claim 1, wherein said button has at least one interior channel cored a substantial distance from the top of the button down inside the button for the release of heat upon molding of the button.

9. The invention of claim 8, wherein the button has an alignment groove in its outer side wall extending downwardly from the top of the button, and two of said interior channels each in communication with and extending away from said alignment groove.

10. A method of in-line capping an aerosol actuator assembly onto a moving aerosol product container toped by an aerosol valve with a valve stem extending upwardly therefrom, comprising: providing an actuator assembly including a shell, an actuator lever having one end hinged to the shell and a free end to pivot, a spray button-receiving socket depending from the lever, and a spray button preassembled into the socket with the bottom end of the spray button being positioned substantially above the bottom end of the button socket and said button having an upwardly extending interior passage with a wide lead-in commencing at the bottom end of the button directly adjacent the button outer wall and converging upwardly to terminate in a valve-stem sealing socket, said bottom end of the button being characterized by the absence of obstructions and unintended valve stem-capturing openings; positioning said actuator assembly over the moving valve stem; initially capturing the valve stem within the portion of the button-receiving socket below the bottom end of the button; and subsequently passing the valve stem up the converging button interior passage into the stem-sealing socket as the in-line capping operation is completed and the shell is connected to the aerosol container.

11. The invention of claim 10, including pivoting the actuator lever upwardly as needed by action of the valve stem to prevent any product-dispensing actuation of the aerosol valve stem during in-line capping.

12. A preassembled aerosol actuator assembly for use with an aerosol product container topped by an aerosol valve with a valve stem extending upwardly therefrom, comprising in combination: an actuator shell having an open bottom and a top with an opening therein; an actuator lever positioned within said opening and having a first end hinged to the shell and a second end free to pivot; a button-receiving socket depending from the lever and having a bottom open end; a discrete spray button preassembled into and retained in said button-receiving socket and having an outer side wall and a bottom end positioned a substantial distance above the bottom open end of said button-receiving socket; said button having an upwardly extending interior passage with a wide lead-in beginning at the bottom end of the button directly adjacent the outer side wall of the button and converging upwardly to terminate in a stem-sealing socket for the valve stem; said bottom end of the button being characterized by the absence of obstructions and unintended valve stem-capturing openings; whereby upon positioning the preassembled aerosol actuator onto the product container during capping, the valve stem is first captured by the button-receiving socket extending below the bottom end of the preassembled button and thereafter is passed up the said interior converging passage of the button without obstruction or misalignment to the stem-receiving socket as the capping is completed.

13. The invention of claim 12, further including means for retaining the valve stem within the button-receiving socket below the preassembled button upon the initiation of capping.

14. The invention of claim 13, wherein said means for retaining comprises a flap.

15. The invention of claim 12, wherein the stem-sealing socket in said button has a sufficiently shallow depth to permit capping of the aerosol actuator assembly without product-dispensing actuation of the aerosol valve stem during capping.

16. The invention of claim 12, wherein the force to pivot the actuator lever upwardly during capping is less than the force to move the valve stem downwardly to product-dispensing position during capping.

17. The invention of claim 12, wherein said button has at least one interior channel cored a substantial distance from the top of the button down inside the button for the release of heat upon molding of the button.

18. A spray button for use in an actuator for an aerosol valve with a valve stem, said button having a spray nozzle, a top end, an outer side wall and a bottom end; said button further having an upwardly extending interior passage with a wide lead-in beginning at the bottom end of the button directly adjacent the outer side wall of the button and converging upwardly to terminate in a stem-sealing socket for receiving the valve stem; said bottom end of the button being characterized by the absence of obstructions and unintended valve stem-capturing openings; said button having at least one interior channel cored a substantial distance from the top of the button down inside the button for the release of heat upon molding of the button.

19. The invention of claim 18, wherein the stem-sealing socket has a shallow depth.

20. The invention of claim 19, wherein said button has an alignment groove or rib for cooperating with a corresponding alignment rib or groove in said actuator assembly.

21. An actuator for use in an actuator assembly for an aerosol valve with a valve stem, said actuator including a shell having a bottom opening with means thereat for attaching the shell to a product container, a side shell wall and a shell top, said shell top having an opening therein; an actuator lever positioned within the shell top opening, said actuator lever having a top surface, a first end hinged to the shell, a second end free to pivot, and a spray button-receiving socket depending from the lever; said socket including a bottom end, a wall extending upwardly from the bottom end, and a slot extending through said socket wall and to the bottom end of said socket; and a flap positioned exterior to said socket directly adjacent to said slot at the bottom end of said slot.

22. The invention of claim 21, wherein said flap is radiused in a direction downwardly and inwardly toward said slot.

* * * * *